US005810573A

United States Patent [19]

Mitsunaga et al.

[11] Patent Number: 5,810,573

[45] Date of Patent: Sep. 22, 1998

[54] SCROLL COMPRESSOR HAVING A BAFFLE PLATE AND OIL PASSAGES IN THE ORBITING SCROLL MEMBER

[75] Inventors: Toshihiko Mitsunaga, Tokyo; Kazuya Sato, Ohara-gun, both of Japan

[73] Assignee: Sanyo Electric Co., Ltd., Osaka-fu, Japan

[21] Appl. No.: 757,582

[22] Filed: Nov. 27, 1996

[30] Foreign Application Priority Data

Nov. 30, 1995 [JP] Japan ..... 7-336088

[51] Int. Cl.[6] ..... F04C 18/04; F04C 29/02

[52] U.S. Cl. ..... 418/55.6; 418/94; 418/99

[58] Field of Search ..... 418/55.6, 99, 94, 418/88

[56] References Cited

U.S. PATENT DOCUMENTS

| | | | |
|---|---|---|---|
| 4,343,599 | 8/1982 | Kousokabe | 418/55.6 |
| 4,755,114 | 7/1988 | Shibayashi et al. | 418/55.6 |
| 5,178,527 | 1/1993 | Jung | 418/55.6 |
| 5,217,359 | 6/1993 | Kawahara et al. | 418/55.4 |
| 5,342,185 | 8/1994 | Anderson | 418/55.4 |
| 5,370,513 | 12/1994 | Fain | 418/55.6 |
| 5,447,418 | 9/1995 | Takeda et al. | 418/55.2 |

FOREIGN PATENT DOCUMENTS

| | | | |
|---|---|---|---|
| 0469700 | 5/1992 | European Pat. Off. . | |
| 37 06 494 A1 | 9/1987 | Germany . | |
| 60-73083 | 4/1985 | Japan | 418/55.6 |
| 62-126282 | 6/1987 | Japan | 418/55.6 |
| 62-168986 | 7/1987 | Japan | 418/55.6 |
| 62-141688 | 9/1987 | Japan . | |
| 63-129177 | 6/1988 | Japan | 418/55.6 |
| 2-49989 | 2/1990 | Japan | 418/55.6 |
| 3-81586 | 4/1991 | Japan | 418/55.6 |
| 2 229 226 | 9/1990 | United Kingdom . | |

OTHER PUBLICATIONS

Patent Abstracts of Japan, vol. 095, No. 009, 31 Oct. 1995 & JP 07 151076 A (Sanyo Electric Co Ltd), 13 Jun. 1995.

*Primary Examiner*—John J. Vrablik

*Attorney, Agent, or Firm*—Weingarten, Schurgin, Gagnebin & Hayes LLP

[57] ABSTRACT

A compression chamber of a scroll compression element driven by a crank shaft of an electromotive element and stored in an upper portion of a closed container is formed by engaging spiral wraps formed on the mirror plates of a fixed scroll member and an orbiting scroll member with each other, a bush portion having an engagement hole to be engaged with an upper end portion of the crank shaft is formed in a central axis portion of the under surface of the mirror plate of the orbiting scroll member, a space formed between the engagement hole of the bush portion and the upper end portion of the crank shaft serves as an oil input port, lubricating oil which is stored in an oil reservoir in an inner bottom portion of the closed container and goes up through an oil passage formed within the crank shaft by an oil pump unit is supplied from the oil input port into the compression chamber, oil injection communication passages communicating with the compression chamber from the oil input port are formed in the mirror plate of the orbiting scroll member, and the open ends on the compression chamber side of the oil injection communication passages are made open to positions near terminal portions of the spiral wraps for an initial-stage compression room formed in the fixed scroll member and the orbiting scroll member.

3 Claims, 8 Drawing Sheets

SCROLL COMPRESSOR HAVING A BAFFLE PLATE AND OIL PASSAGES IN THE ORBITING SCROLL MEMBER

BACKGROUND OF THE INVENTION

1. Field of the Invention

This invention relates to a scroll compressor to be mounted on an air conditioner, a refrigerator or the like and, more specifically, to a scroll compressor comprising improvement in the structure of an oil injection unit to a scroll compressing element to allow for the control of the amount of lubricating oil to be injected into a compression chamber under operation at a low-speed/high-speed revolution and maintain stable sealability to obtain sufficient compression efficiency and prevent a reduction in energy efficiency ratio caused by an increase in input.

2. Background Art

Heretofore, in this type of scroll compressor, as disclosed in Laid-open Japanese Utility Model Application No. Sho 62-141688, a scroll compression element is stored in an upper portion of a closed container having an inner bottom portion as a lubricating oil reservoir and driven by a crank shaft which is an electromotive element stored in a lower portion of the closed container to absorb a refrigerant gas supplied from a suction pipe facing a low-pressure space side of the closed container into a compression chamber which is the scroll compression element and compress it and to deliver the compressed refrigerant gas into a high-pressure space formed on the rear side of an upper portion of the scroll compression element and discharge it from a discharge pipe communicating with this high-pressure space.

This scroll compression element is fixed in the closed container and consists of a fixed scroll member having a spiral wrap formed on an under surface portion thereof and an orbiting scroll member having on a top surface portion thereof a spiral wrap which is engaged with the spiral wrap of the fixed scroll member to form the compression chamber and orbitably supported by a main frame fixed in the closed container.

Such a scroll compressor has been considered to be reliable in performance as it has excellent compression efficiency because it consists of a plurality of compression rooms having small pressure differences and a small leakage of the refrigerant gas. However, the actual current situation is such that a considerable amount of refrigerant gas leaks due to the processing accuracy of the spiral wrap formed on each of the mirror plates of the fixed scroll member and the orbiting scroll member.

Then, in the prior art, to enhance the sealability of the refrigerant gas in the compression chamber which is the scroll compression element, a bush portion having an engagement hole to be engaged with an upper end portion of the crank shaft is formed in a central axis portion of the under surface of the mirror plate of the orbiting scroll member, for example, a space formed between the engagement hole of the bush portion and the upper end portion of the crank shaft serves as an oil input port, and an oil injection unit is formed to supply lubricating oil which goes up from an oil reservoir in the inner bottom portion of the closed container through an oil passage formed within the crank shaft by an oil pump unit from the oil input port into an initial-stage compression room of the compression chamber together with the refrigerant gas.

However, since, in the scroll compression element of the scroll compressor having the structure of the prior art as described above, the number of revolutions can be changed by varying the frequency of the electromotive element with an inverter to increase the energy efficiency ratio (EER) of the compressor, the injection amount of oil differs according to the number of revolutions. As the number of revolutions decreases, a larger injection amount of oil is required. Since the circulation amount of the refrigerant gas increases and the amount of oil contained in the refrigerant gas is large at a high-speed revolution, a large amount of oil to be supplied by the oil injection unit is not required.

However, when a large amount of oil is supplied by the oil injection unit at such a high-speed revolution, the lubricating oil stored in the oil reservoir in the inner bottom portion of the closed container sharply decreases with the result of not only a reduction in oil level but also impossibility of supplying oil to the compression chamber, whereby stable sealability of the compression chamber cannot be maintained. As a result, sufficient compression efficiency cannot be obtained and the energy efficiency ratio (EER) of the compressor is adversely affected by an increase in input.

It is therefore an object of the present invention to provide a scroll compressor which is capable of controlling the amount of lubricating oil to be injected into the compression chamber by means of the oil injection unit under operation at a low-speed/high-speed revolution, maintaining stable sealability, obtaining sufficient compression efficiency and preventing a reduction in EER due to an increase in input.

SUMMARY OF THE INVENTION

To attain the above object, a first aspect of the present is constituted such that, in a scroll compressor in which a scroll compression element is stored in an upper portion of a closed container having an oil reservoir for lubricating oil in an inner bottom portion thereof, is driven by a crank shaft of an electromotive element stored below the scroll compression element to compress a refrigerant gas absorbed into a compression chamber of the scroll compression element, and consists of an upper fixed scroll member having a spiral wrap formed on a mirror plate and a lower orbiting scroll member having formed on a mirror plate a spiral wrap which is orbitably engaged with the spiral wrap of the fixed scroll member to form the compression chamber, the orbiting scroll member has in a central axis portion of the under surface of the mirror plate a bush portion having an engagement hole to be engaged with an upper end portion of the crank shaft, a space formed between the engagement hole of the bush portion and the upper end portion of the crank shaft serves as an oil input port, and lubricating oil which goes up from the oil reservoir through an oil passage formed within the crank shaft by an oil pump unit is supplied from the oil input port into the compression chamber, oil injection communication passages communicating with the compression chamber from the oil input port in the central axis portion are formed in the mirror plate of the orbiting scroll member, and open ends on the compression chamber side of the oil injection communicating passages are made open to positions near the terminal portions of the spiral wraps for an initial-stage compression room formed in the fixed scroll member and the orbiting scroll member.

In a second aspect of the present invention, the oil input port which the open ends of the oil injection communication passages face is formed in a stepped space portion.

Further a third aspect of the present invention is further constituted such that a baffle plate is provided on the upper rear surface side of the scroll compression element, a space formed between the baffle plate and the top surface portion of the closed container serves as a discharge muffler portion communicating with the high-pressure side of the compression chamber, the high-pressure refrigerant gas compressed in the compression chamber is discharged to the outside of the closed container through this muffler space, and an oil return passage communicating with the low-pressure space side of the closed container is formed in the baffle plate forming the muffler space of the discharge muffler portion.

BRIEF DESCRIPTION OF THE DRAWINGS

These and other objects and advantages of the present invention will become apparent from the following description with reference to the accompanying drawings, wherein.

DETAILED DESCRIPTION OF THE PREFERRED EMBODIMENTS

Figure 1:
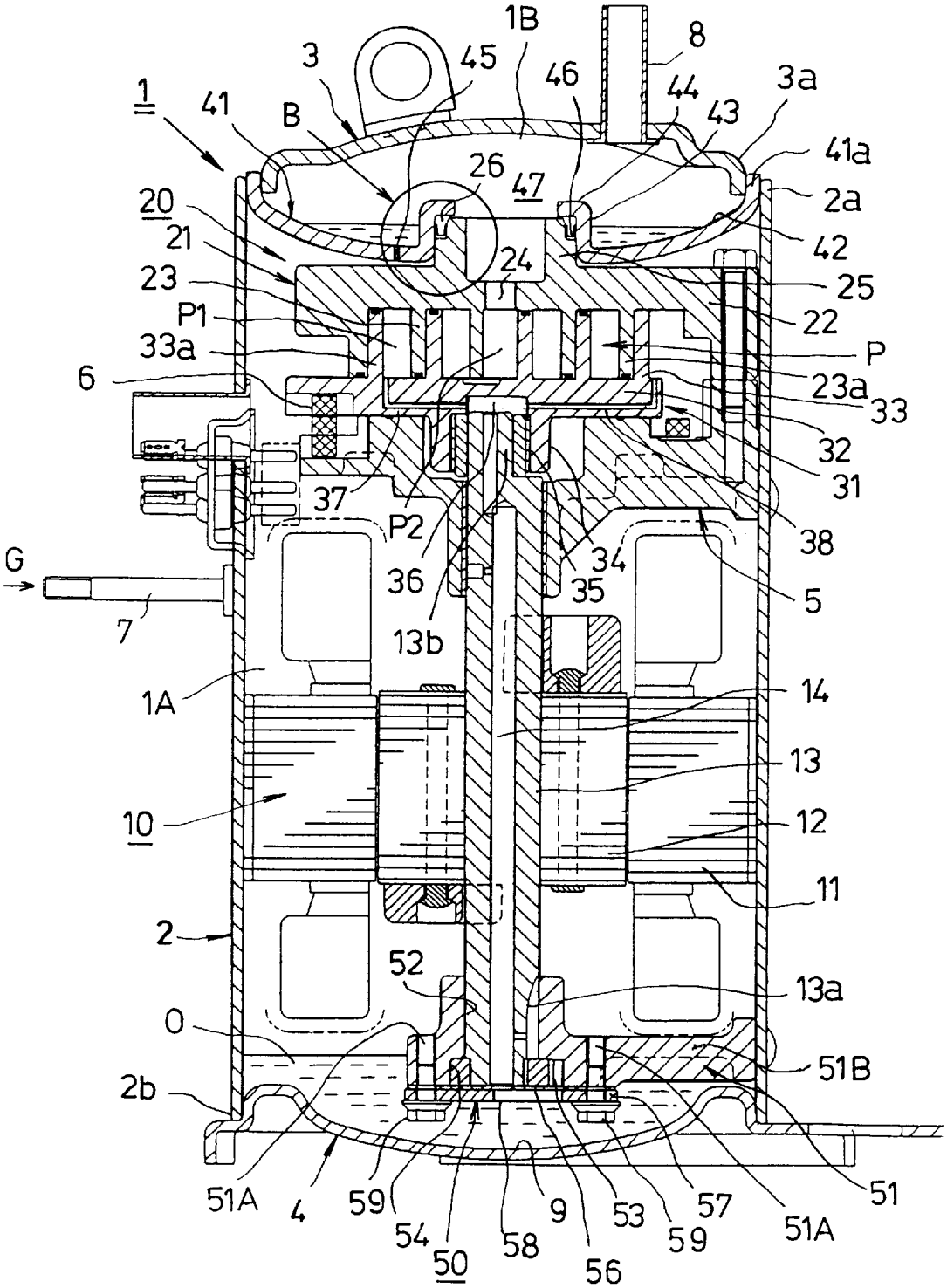
FIG. 1 is a sectional view of a scroll compressor according to an embodiment of the present invention.

Preferred embodiments of the present invention are described in detail with reference to the accompanying drawings. FIG. 1 shows the entire configuration of a scroll compressor according to the present invention. Reference numeral 1 in the figure is a closed container which is composed of a cylindrical barrel portion 2 and end caps 3,4 for covering upper and lower end portions 2*a*, 2*b* of the barrel portion 2.

An electromotive element 10 is stored in a lower portion of the closed container 1 and a scroll compression element 20 is stored above the electromotive element 10. The electromotive element 10 consists of a stator 11 and a rotor 12 inserted into the central axis portion of this stator 11 such that it can rotate. A crank shaft 13 for driving the scroll compression element 20 is press fitted in the central axis portion of this rotor 12.

The above scroll compression element 20 consists of an upper fixed scroll member 21 fixed in the closed container 1 and a lower orbiting scroll member 31 which is orbitably supposed by a main frame 5 fixed in the closed container 1 through an Oldham ring 6. A spiral wrap 23 formed on the under surface portion of a mirror plate 22 of the fixed scroll member 21 is engaged with a spiral wrap 33 formed on a top surface portion of a mirror plate 32 of the orbiting scroll member 31 to form a compression chamber P.

Reference numeral 7 in the figure is a suction pipe for a refrigerant gas G provided on an exterior side portion of the closed container 1, which faces a low-pressure space 1A in the closed container 1 so that the refrigerant gas G supplied into this low-pressure space 1A is absorbed into an initial-stage compression room P1 in the compression chamber P of the scroll compression element 20 and compressed while it is supplied to a late-stage compression room P2 in the central axis portion of the scroll compression element 20. This refrigerant gas G compressed in this scroll compression element 20 is discharged from a discharge port 24 communicating with the late-stage compression room P2 which is open to the mirror plate 22 of the fixed scroll member 21 to a high-pressure space 1B in an upper portion of the closed container 1 and further discharged from a discharge pipe 8 provided in the upper end cap 3 of the closed container 1 to an unshown external refrigerant unit circuit.

Further, the inner bottom portion of the closed container 1 serves as an oil reservoir 9 for lubricating oil O, and the lubricating oil O stored in this oil reservoir 9 goes up through an oil passage 14 extending through the crank shaft 13 by an oil pump unit 50 to be described later provided such that it is coupled with a lower end portion 13*a* of a crank shaft 13 of the electromotive element 10 and is discharged to an eccentric axis portion 13*b* which is an upper end portion of the crank shaft 13.

Figure 2:
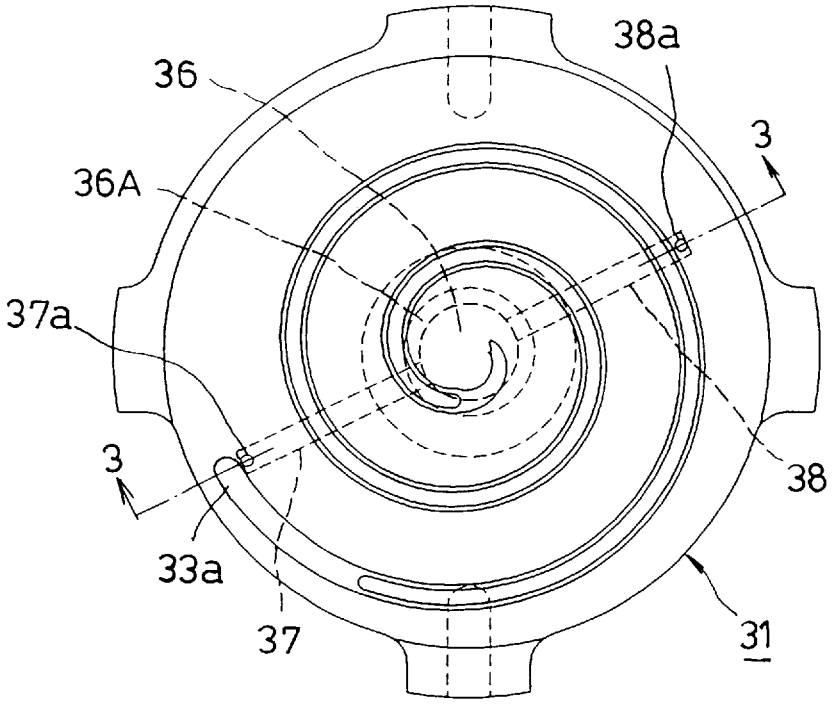
FIG. 2 is a plan view of an orbiting scroll member of a scroll compression element.
Figure 3:
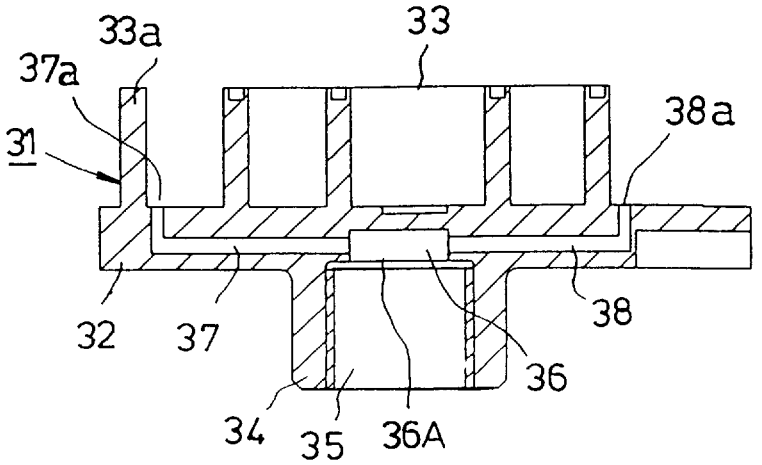
FIG. 3 is a sectional view taken on line 3—3 of FIG. 2.

As shown in FIGS. 2 and 3, a bush portion 34 is formed integrally in a central axis portion of the under surface of the mirror plate 32 of the orbiting scroll member 31 of the scroll compression element 20 such that it projects from the under surface. The eccentric axis portion 13*b* which is the upper end portion of the crank shaft 13 is fitted in an engagement hole 35 formed in the bush portion 34 to drive the orbiting scroll member 31. A space formed between the engagement hole 35 and the eccentric axis portion 13*b* at the upper end of the crank shaft 13 is formed in a stepped space portion 36A as an oil input port.

That is, the lubricating oil O stored in the above oil reservoir 9 goes up through the oil passage 14 by the oil pump unit 50 which is described hereinafter to be discharged to the eccentric axis portion 13*b* which is the upper end portion of the crank shaft 13 and introduced into this oil input port 36. This lubricating oil O is supplied from an oil groove (not shown) formed in a thrust surface between the mirror plate 32 of the orbiting scroll member 31 and the main frame 5 to the initial-stage compression room P1 of the compression chamber P of the scroll compression element 20 together with the refrigerant gas G.

Two oil injection communication passages 37, 38 constituting an oil injection unit communicating with the compression chamber P from the stepped space portion 36A of the oil input port 36 on the central axis portion side are formed in the mirror plate 32 of the orbiting scroll member 31 and have opening ends 37*a*, 38*a* on the side of the compression chamber P which are open to positions near terminal portions 23*a*, 33*a* of the spiral wraps 23, 33 formed in the fixed scroll member 21 and orbiting scroll member 31, respectively, and face the initial-stage compression room P1 in the compression chamber P.

Further, a baffle plate 41 is provided on the upper rear side of the scroll compression element 20 in the closed container 1 and is formed of a pressed steel plate having a double cylindrical shape and having an outer peripheral edge portion 41*a* which is formed like an upright cylinder and a cylindrical engagement mouth portion 43 to be engaged with a boss portion 25 formed in the upper fixed scroll member 21 of the scroll compression element 20 at the center of the inner bottom portion 42. The inner bottom portion 42 is shaped like a saucer to serve as an oil reservoir curved inward in the form of a circular arc, the cylindrical engagement mouth portion 43 is formed upright at the center thereof, a flange portion 44 which functions as a stopper is formed at the inner periphery of the upper end of the engagement mouth portion 43, and an oil return passage 45 which communicates with the low-pressure space 1A in the closed container 1 is formed at a position near the center of the inner bottom portion 42.

Figure 4:
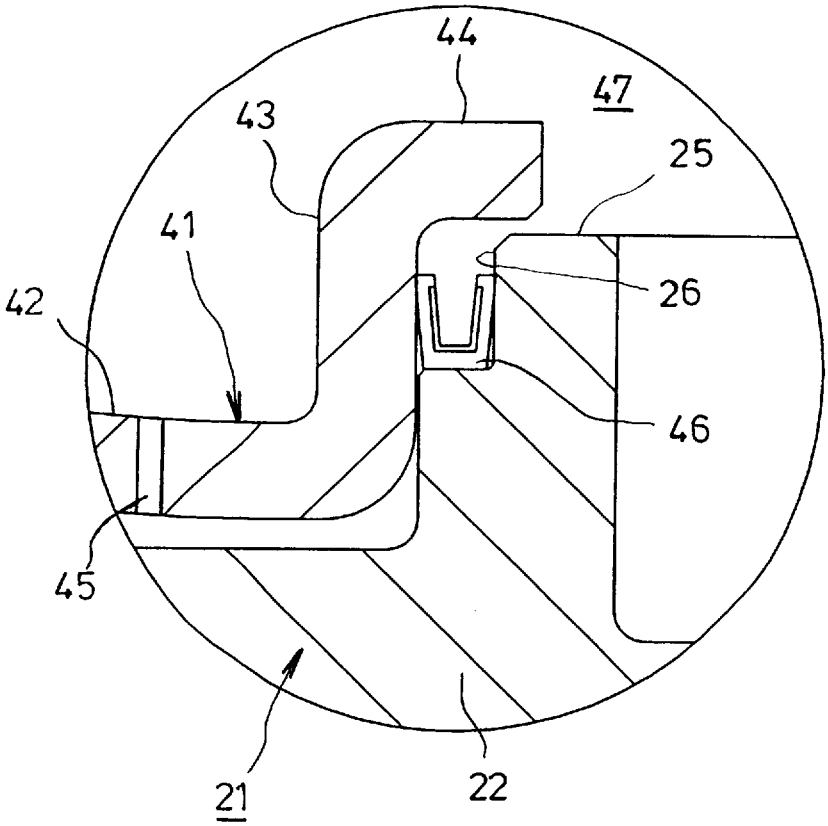
FIG. 4 is an enlarged sectional view of portion B of FIG. 1.
Figure 5:
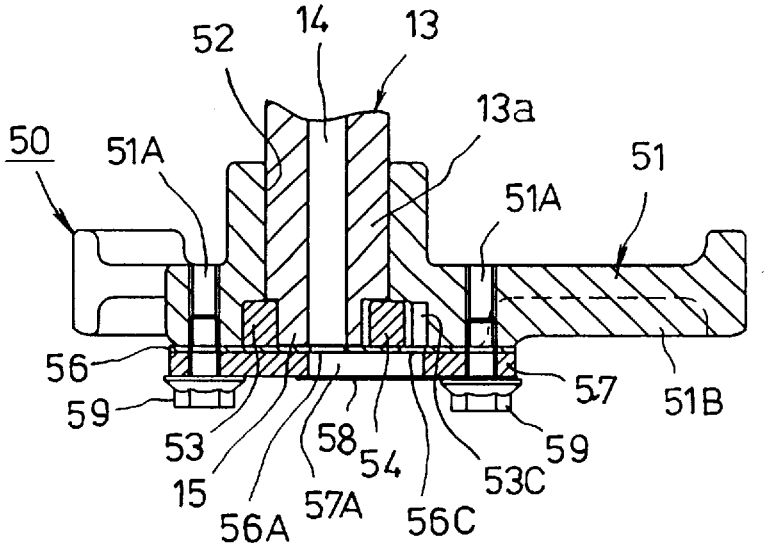
FIG. 5 is a sectional view of an oil pump unit.
Figure 6:
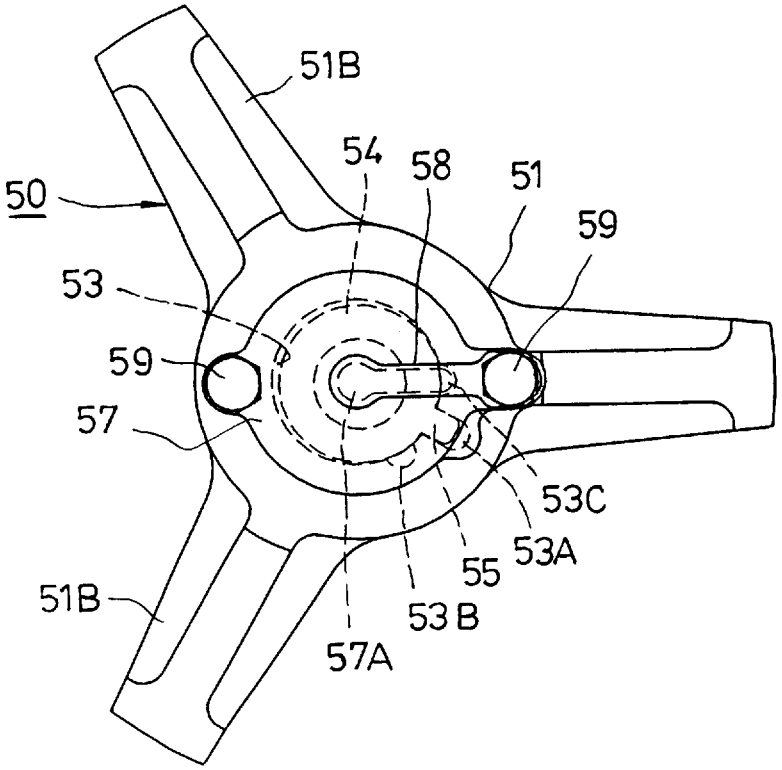
FIG. 6 is a bottom view of the oil pump unit.
Figure 7:
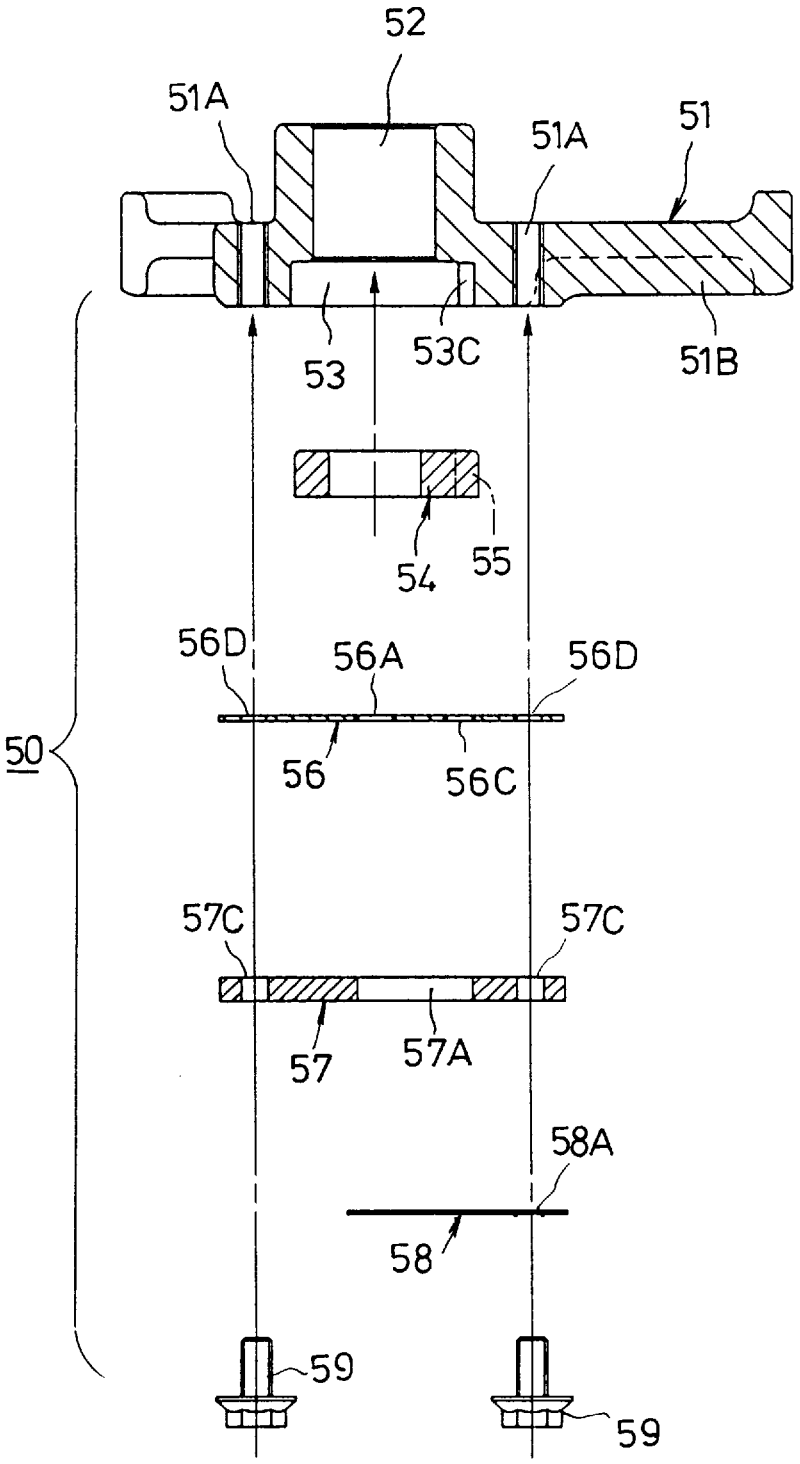
FIG. 7 is an exploded view of the oil pump unit.
Figure 8:
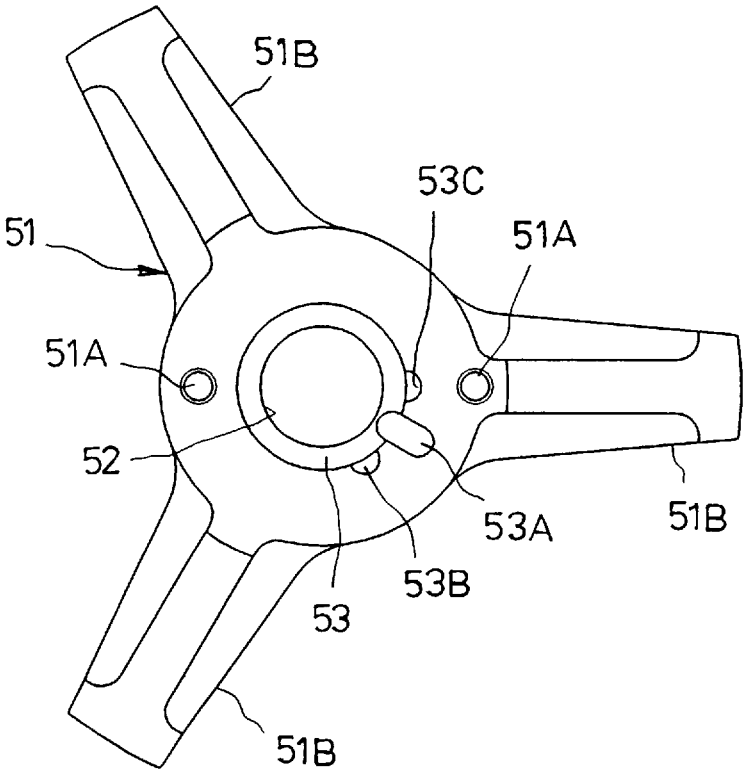
FIG. 8 is a bottom view of a bearing plate forming the oil pump unit.
Figure 9:
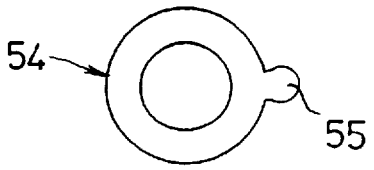
FIG. 9 is a plan view of a rotor forming the oil pump unit.
Figure 10:
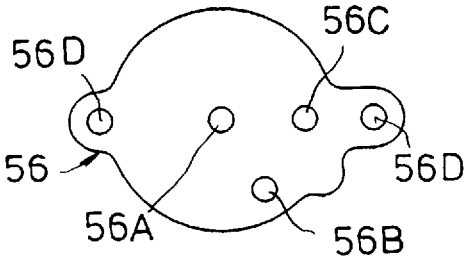
FIG. 10 is a plan view of a thrust plate forming the oil pump unit.
Figure 11:
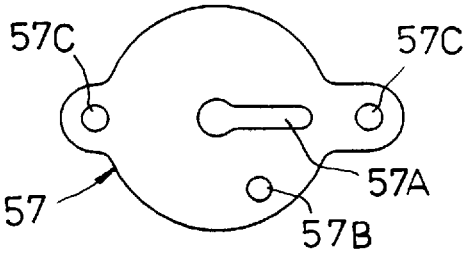
FIG. 11 is a plan view of a cover member forming the oil pump unit.
Figure 12:
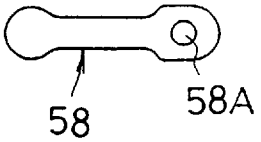
FIG. 12 is a plan view of a relief valve forming the oil pump unit.

The outer peripheral edge portion 41*a* of the baffle plate 41 is fixed to the outer peripheral edge portion 3*a* of the end cap 3 to be capped onto the upper end portion 2*a* of the barrel portion 2 of the closed container 1 by welding, and, as shown in FIG. 4, the engagement mouth portion 43 is fixed without contact to the outer peripheral side surface of the boss portion 25 projecting from the central axis portion on the upper rear side of the mirror plate 22 of the fixed scroll member 21 through a radial seal ring 46 having a U-shaped cross section to be fitted in a seal groove 26. The flange portion 44 which serves as the stopper can be positioned above the boss portion 25 projecting from the mirror plate 22 of the fixed scroll member 21.

That is, the baffle plate 41 partitions the closed container 1 such that space 47 above the engagement mouth portion 43 formed between the end cap 3 and the baffle plate 41 becomes a discharge muffler portion communicating with the late-stage compression room P2 on the high-pressure side through the discharge port 24 formed in the fixed scroll member 21, discharges the high-pressure refrigerant gas G compressed in the compression chamber P from the discharge pipe 8 through the muffler space 47 forming this high-pressure space 1B, and has an oil separator function to return the lubricating oil O to the oil reservoir 9 in the inner bottom portion of the closed container 1 by flowing out the lubricating oil O stored in the inner bottom portion 42 thereof, which is sprayed onto the interior surface of the end cap 3 together with the refrigerant gas G, is separated from the gas and drops down to the side of the low-pressure space 1A of the closed container 1 from the oil return passage 45.

The oil pump unit 50, as shown in FIGS. 5 to 12, consists of a bearing plate 51 formed of an aluminum die cast molding fixed to the inner bottom portion side of the closed container 1, a bearing hole 52 formed on the lower end surface side of the bearing plate 51 and penetrating the central axis portion thereof, a cylinder chamber 53 facing the eccentric axial portion 15 on the lower end portion 13*a* side of the crank shaft 13 supported by this bearing hole 52, a vane slot 53A, a cutaway portion 53B for use as an oil suction port and a cutaway portion 53C for use as an oil exhaust port formed in the interior wall of the cylinder chamber 53, a rotor 54 incorporated in the cylinder chamber 53 such that it can orbit by the rotation of the eccentric axis portion 15 at the lower end of the crank shaft 13 and provided integrally with a vane 55 which projects from the outer peripheral side thereof and is fitted in the vane slot 53A, a thrust plate 56 supporting the rotor 54 such that it can thrust the rotor 54 freely, and a cover member 57 covering the cylinder chamber 53 incorporating the rotor through the thrust plate 56.

The thrust plate 56 is formed of a press punched material such as carbon steel (valve steel) provided with a first oil hole 56A communicating with the oil passage 14 which is made open to the eccentric axis portion 15 side of the crank shaft 13, a second oil suction hole 56B and a third oil exhaust hole 56C communicating with the cutaway portion 53B for use as an oil suction port and the cutaway portion 53C for use as an oil exhaust port formed in the interior wall of the cylinder chamber 53, respectively. The cover member 57 is formed of a pressed steel plate provided with a prolonged relief groove 57A communicating with the third oil exhaust hole 56C of the thrust plate 56 and the oil passage 14 of the crank shaft 13 and an oil suction hole 57B communicating with the cutaway portion 53B for use as an oil suction port formed in the interior wall of the cylinder chamber 53 and the second oil suction hole 56B of the thrust plate 56. The relief groove 57A is open to the side of the oil reservoir 9, this open portion is closed with a lead valve 58. The thrust plate 56, the cover member 57 and the lead valve 58 are fastened and fixed to one another as a single assembly by tightening bolts 59, 59 into bolt holes 51A, 51A formed in the lower end surface of the bearing plate 51.

A plurality of (three in the illustrated embodiment) fixing feet 51B extend from the bearing plate 51 towards the interior peripheral side surface of the closed container 1. The cutaway portion 53C for use as an oil exhaust port formed in the bearing plate 51 and the bolt holes 51A, 51A are arranged in the same direction as the extending direction of one of the fixing feet. The two bolt holes 56D, 56D formed in the thrust plate and the two bolt holes 57C, 57C formed in the cover member 57 corresponding to the respective bolt holes 51A, 51A of the bearing plate 51, the first hole 56A communicating with the oil passage 14 of the crank shaft 13, and the oil exhaust hole 56C or the relief groove 57A are arranged on the same line.

That is, since this invention employs the above constitution, the compression chamber P of the scroll compression element 20 driven by the crank shaft 13 of the electromotive element 10 stored in an upper portion of the closed container 1 is formed by engaging the spiral wraps 23, 33 formed on the mirror plates 22, 32 of the fixed scroll member 21 and the orbiting scroll member 31 with each other, the bush portion 34 having the engagement hole 35 to be engaged with the upper end portion 13*a* of the crank shaft 13 is formed in the central axis portion of the under surface of the mirror plate 32 of the orbiting scroll member 11, and the space formed between the engagement hole 35 of the bush portion 34 and the upper portion 13*b* of the crank shaft 13 serves as an oil input port 36, and the lubricating oil O which is stored in the oil reservoir 9 in the inner bottom portion of the closed container 1 and goes up through the oil passage 14 formed within the crank shaft 13 by the oil pump unit 50 is supplied from the oil input port 36 into the compression chamber P. Meanwhile, the oil injection communication passages 37, 38 communicating with the compression chamber P from the oil input port 36 are provided in the mirror plate 32 of the orbiting scroll member 31, and the open ends 37*a*, 38*a* on the compression chamber side of the oil injection communication passages 37, 38 are made open to positions near the terminal portions 23*a*, 33*a* of the spiral wraps 23, 33 for the initial-stage compression room P1 formed in the fixed scroll member 21 and the orbiting scroll member 31, respectively.

Figure 13:
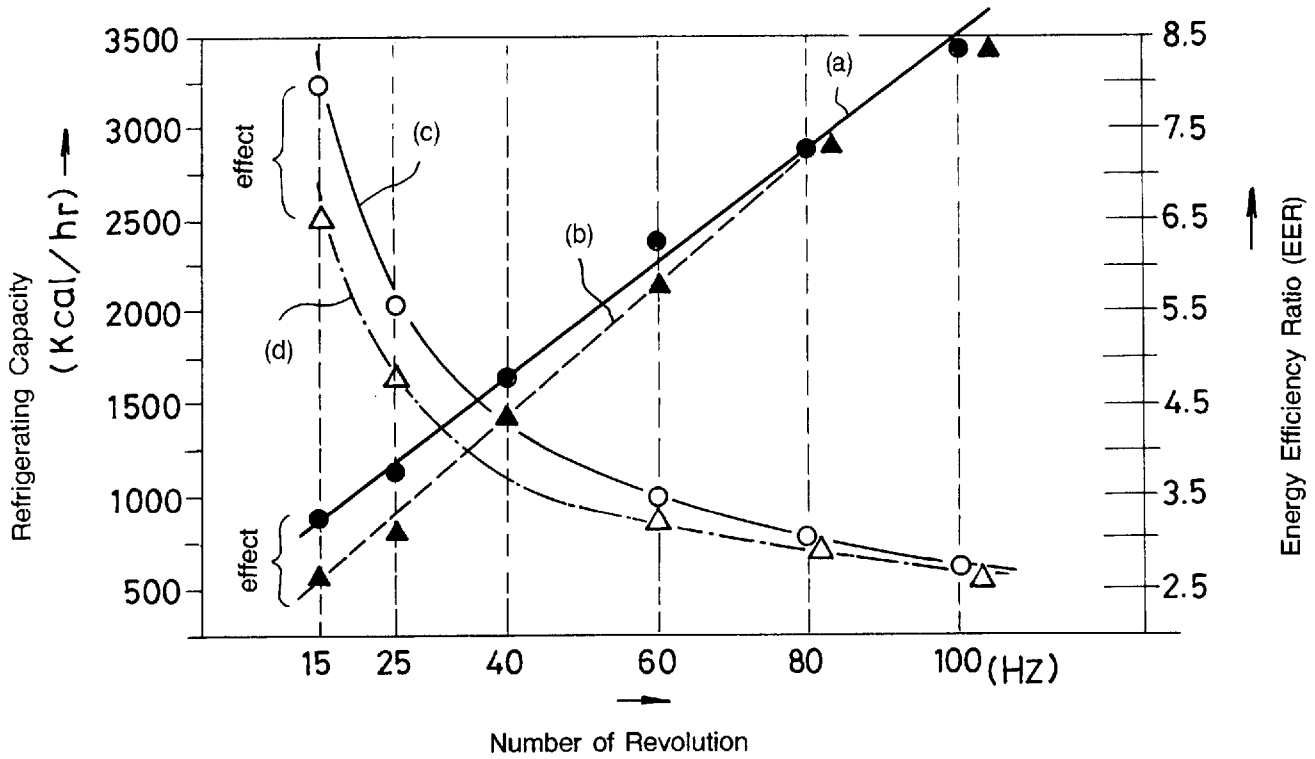
FIG. 13 is a diagram for explaining the measurement results of refrigerating capacity and energy efficiency ratio (EER) at low- and high-speed revolutions.

Therefore, the lubricating oil O going up by the oil pump unit 20 is supplied through the oil injection communication passages 37, 38 from the oil input port 36 into the initial-stage compression room P1 of the compression chamber P, whereby the sealability of the compression chamber P is enhanced and hence, the leakage of the refrigerant gas G being compressed is reduced. As shown in FIG. 13, particularly at a low-speed revolution range having a frequency of 14 Hz and 25 Hz, the refrigerating capacity (a) is higher than the conventional refrigerating capacity (b) and yet a power loss is reduced by a reduction in the leakage of the refrigerant gas G, thereby making it possible to reduce input and increase the energy efficiency ratio (c) to a value higher than the conventional energy efficiency ratio (d).

Since the oil input port 36 which the open ends 37*a*, 38*a* of the oil injection communication passages 37, 38 face is formed in the stepped space portion 36A, the centrifugal force of the lubricating oil O introduced into the oil input port 36 increases, and passage resistance grows during operation at a high-speed revolution, the amount of the lubricating oil O flown into the oil injection communication passages 37, 38 decrease, whereby, even if the injection amount of oil at a high-speed revolution range having a frequency of 60 Hz or more greatly reduces and the circulation amount of the refrigerant gas increases, a drop in oil level caused by a sharp reduction in the amount of lubricating oil stored in the oil reservoir 9 as seen in the prior art can be prevented.

Further, the baffle plate 41 is provided on the upper rear surface side of the scroll compression element 20, the space 47 formed between the baffle plate 41 and the interior surface of the end cap 3 which is a top surface portion of the closed container 1 is made a discharge muffler portion communicating with the late-stage compression room P2 on the high-pressure side of the compression chamber P, the high-pressure refrigerant gas G compressed in the compression chamber P is discharged to the outside of the closed container 1, and the oil return passage 45 communicating with the low-pressure space 1A side of the closed container 1 is formed in the baffle plate 41 forming the muffler space of the discharge muffler portion.

Therefore, the lubricating oil O which is sprayed onto the interior surface of the end cap 3 together with the refrigerant gas G, is separated and drops down can be stored in the inner bottom portion 42 of the baffle plate 41, flown out to the low-pressure space 1A side of the closed container 1 from the oil return passage 44, and returned to the oil reservoir 9 in the inner bottom portion of the closed container 1, whereby, even if the circulation amount of the refrigerant gas G increases, a drop in oil level caused by a sharp reduction in the amount of the lubricating oil O stored in the oil reservoir 9 as seen in the prior art can be prevented.

As is obvious from the above description, this invention is constituted such that the compression chamber of the scroll compression element driven by the crank shaft of the electromotive element and stored in an upper portion of the closed container is formed by engaging the spiral wraps formed on the mirror plates of the fixed scroll member and the orbiting scroll member with each other, the bush portion having the engagement hole to be engaged with the upper end portion of the crank shaft is formed in the central axis portion of the under surface of the mirror plate of the orbiting scroll member, the space formed between the engagement hole of the bush portion and the upper end portion of the crank shaft serves as an oil input port, the lubricating oil which is stored in the oil reservoir in the inner bottom portion of the closed container and goes up through the oil passage formed within the crank shaft by the oil pump unit is supplied from the oil input port into the compression chamber, the oil injection communication passages communicating with the compression chamber from the oil input port are formed in the mirror plate of the orbiting scroll member, and the open ends on the compression chamber side of the oil injection communication passages are made open to positions near the terminal portions of the spiral wraps for the initial-stage compression room formed in the fixed scroll member and the orbiting scroll member. Therefore, the lubricating oil which goes up by the oil pump unit is forcedly supplied into the initial-stage compression room of the compression chamber, whereby the sealability of the compression chamber can be improved and the leakage of the refrigerant gas being compressed can be reduced, thereby increasing the refrigerating capacity at a low-speed revolution range and yet reducing a power loss by a reduction in the leakage of the refrigerant gas. As a result, input can be reduced and energy efficiency ratio can be increased.

As described in the second aspect of the present invention, since the oil input port which the open ends of the oil injection communication passages face is formed in a stepped space portion, the centrifugal force of the lubricating oil introduced into the oil input port becomes large during operation at a high-speed revolution and passage resistance becomes large, whereby the amount of the lubricating oil flown into the oil injection communication passages can be reduced, thereby making it possible to greatly reduce the injection amount of oil at a high-speed revolution range. As a result, even if the circulation amount of the refrigerant gas increases, a drop in oil level caused by a sharp reduction in the amount of the lubricating oil stored in the oil reservoir as seen in the prior art can be prevented and sufficient compression efficiency can be obtained.

Further, as described in the third aspect of the present invention, since the baffle plate is provided on the upper rear surface side of the scroll compression element, the space formed between the top surface portion of the closed container and the baffle plate serves as a discharge muffler portion communicating with the high-pressure side of the compression chamber, and the high-pressure refrigerant gas compressed in the compression chamber is discharged to the outside of the closed container through this muffler space, noise can be reduced.

In addition, since the oil return passage communicating with the low-pressure space side of the closed container is formed in the baffle plate forming the muffler space of the discharge muffler portion, the lubricating oil which is sprayed onto the top surface of the closed contained together with the refrigerant gas, is separated and drops down can be stored in the inner bottom portion of the baffle plate, flown to the low-pressure space side of the closed container from the oil return passage and returned to the oil reservoir in the inner bottom portion of the closed container. Therefore, even if the circulation amount of the refrigerant gas increases, a drop in oil level caused by a sharp reduction in the amount of the lubricating oil stored in the oil reservoir as seen in the prior art can be prevented.

What is claimed is:

1. A scroll compressor in which a scroll compression element is stored in an upper portion of a closed container having an oil reservoir for lubricating oil in an inner bottom portion thereof, is driven by a crank shaft of an electromotive element stored below the scroll compression element to compress a refrigerant gas absorbed into a compression chamber of the scroll compression element, and consists of an upper fixed scroll member having a spiral wrap formed on a mirror plate and a lower orbiting scroll member having formed on a mirror plate a spiral wrap which is orbitally engaged with the spiral wrap of the fixed scroll member to form the compression chamber, the orbiting scroll member has in a central axis portion of the under surface of the mirror plate a bush portion having an engagement hole to be engaged with an upper end portion of the crank shaft, a space formed between the engagement hole of the bush portion and the upper end portion of the crank shaft serves as an oil input port, and lubricating oil which goes up from the oil reservoir through an oil passage formed within the crank shaft by an oil pump unit is supplied from the oil input port into the compression chamber, wherein oil injection communication passages communicating with the compression chamber from the oil input port in the central axis portion are formed in the mirror plate of the orbiting scroll member; and open ends on the compression chamber side of the oil injection communicating passages are made open to positions near the terminal portions of the spiral wraps for an initial-stage compression room formed by the spiral wraps of the fixed scroll member and the orbiting scroll member.

2. A scroll compressor according to claim 1, wherein the oil input port which the open ends of the oil injection communication passages face is formed in a stepped space portion.

3. A scroll compressor in which a scroll compression element is stored in an upper portion of a closed container having an oil reservoir for lubricating oil in an inner bottom portion thereof, is driven by a crank shaft of an electromotive element stored below the scroll compression element to compress a refrigerant gas absorbed into a compression chamber of the scroll compression element, and consists of an upper fixed scroll member having a spiral wrap formed on a mirror plate and a lower orbiting scroll member having formed on a mirror plate a spiral wrap which is orbitally engaged with the spiral wrap of the fixed scroll member to form the compression chamber, the orbiting scroll member has in a central axis portion of the under surface of the mirror plate a bush portion having an engagement hole to be engaged with an upper end portion of the crank shaft, a space formed between the engagement hole of the bush portion and the upper end portion of the crank shaft serves as an oil input port, and lubricating oil which goes up from the oil reservoir through an oil passage formed within the crank shaft by an oil pump unit is supplied from the oil input port into the compression chamber, wherein a baffle plate is provided on the upper rear surface side of the scroll compression element, a space formed between the baffle plate and a top surface portion of the closed container serves as a discharge muffler portion communicating with the high-pressure side of the compression chamber, the high-pressure refrigerant gas compressed in the compression chamber is discharged to the outside of the closed container, and an oil return passage communicating with the low-pressure space side of the closed container is formed above the mirror plate of the upper fixed scroll member in the baffle plate forming the discharge muffler portion.

* * * * *